United States Patent [19]

Gunneman et al.

[11] 4,446,893

[45] May 8, 1984

[54] METHOD FOR TRANSPORTING A WEFT THREAD THROUGH THE WEAVING SHED OF A WEAVING MACHINE THROUGH THE INTERMEDIARY OF A FLOWING FLUID, AND WEAVING MACHINE ADAPTED FOR THE APPLICATION OF THIS METHOD

[75] Inventors: Paul Gunneman, Mierlo; Gerardus W. Jeuken, Deurne, both of Netherlands

[73] Assignee: Ruti-Te Strake B.V., Deurne, Netherlands

[21] Appl. No.: 205,013

[22] Filed: Nov. 7, 1980

[30] Foreign Application Priority Data

Nov. 15, 1979 [NL] Netherlands ..... 7908357

[51] Int. Cl.[3] ..... D03D 41/00

[52] U.S. Cl. ..... 139/11; 139/116; 139/435

[58] Field of Search ..... 139/116, 435, 452, 370.2, 139/11

[56] References Cited

U.S. PATENT DOCUMENTS

| | | | |
|---|---|---|---|
| 4,020,877 | 5/1977 | Spisiak et al. | 139/435 |
| 4,298,172 | 11/1981 | Hellstrom | 139/452 |

FOREIGN PATENT DOCUMENTS

| | | | |
|---|---|---|---|
| 533686 | 11/1976 | U.S.S.R. | 139/435 |
| 632773 | 11/1978 | U.S.S.R. | 139/435 |
| 735683 | 5/1980 | U.S.S.R. | 139/435 |

*Primary Examiner*—Henry Jaudon

*Attorney, Agent, or Firm*—C. O. Marshall, Jr.

[57] ABSTRACT

The speed of the movement of each weft thread through the shed is correlated with the speed of operation of the weaving machine by measuring the time occupied by movement of a weft thread through the shed, generating a first electrical signal which is a measure of such time, generating a second electrical signal which is a measure of a predetermined fraction of the time occupied by a weaving cycle of the machine, comparing said electrical signals and generating a third electrical signal which is a measure of the discrepancy between the first and second signals, and using the third signal to control one of such speeds in order to eliminate the discrepancy between the first and second signals.

6 Claims, 3 Drawing Figures

METHOD FOR TRANSPORTING A WEFT THREAD THROUGH THE WEAVING SHED OF A WEAVING MACHINE THROUGH THE INTERMEDIARY OF A FLOWING FLUID, AND WEAVING MACHINE ADAPTED FOR THE APPLICATION OF THIS METHOD

The invention relates to a method for transporting a weft thread through the weaving shed of a weaving machine through the intermediary of a plurality of nozzles fed with a flowing transport fluid.

In the present state of the art considerably higher transport velocities may be achieved with weft systems operating through a flowing transport fluid than with other types of weft transport systems. Particularly pneumatic weaving machines may thereby operate at considerably higher numbers of revolutions than weaving machines provided with different weft transport systems.

For obtaining as high as possible thread velocities in the weft transport through a flowing fluid one is dependent on a correct pulse transmission of the transport fluid to the weft yarn. Many structural measures have already been proposed in order to optimalize the conditions for the best possible pulse transmission with yarns of different type (such as smoother yarns and more fibrous yarns). It is also known to adapt the machine to a new weft yarn if in such a weft transport system a change is made to a different kind of weft yarn, e.g. by differently adjusting the pressure in one or more of the nozzles and adapting the number of revolutions of the machine to the velocities attainable with this new weft yarn.

Apart from the highest possible transport velocity of the weft yarn it is at least as important for the correct and efficient operation of the weaving machine that the successive weft threads have finished their weft movement with the least possible variations on predetermined points of time within the complete weaving cycle. A weft thread arriving too early as well as too late within the relative weaving cycle at the end of its weft movement may produce errors in the cloth. In practice therefore up till now the operation is such that within the weaving cycle a so wide time tolerance for the weft is permitted and so much transport fluid energy is supplied that one is practically sure that the slowest as well as the quickest weft thread will remain within this marginal difference. However, this method of operation is far from economical.

Therefore the invention aims at proposing measures for removing this disadvantage. Extensive experiments have led to the recognition that the differences found in weft periods and transport velocity respectively between successive wefts of the same weft yarn mainly originate in the yarn itself and particularly are the result of the variation in the air resistance of the yarn.

Using this recognition the invention now proposes to use the quantity which is representative for the behaviour of the weft yarn, such as its velocity, as the control quantity for controlling the weaving machine. Therein the operation may be according two different principles.

According to a first principle the transport velocity of each weft thread is measured, a signal, which is representative for the measured transport velocity, is supplied to a control system, in which this signal is converted into a control signal which changes the machine's number of revolutions per minute such that the time period necessary for the weft transport of a thread constitutes a substantially constant portion of the momentary weaving cycle time determined by the number of revolutions per minute. Thereby one achieves that the machine may operate at each moment with the highest possible number of revolutions, namely with a number of revolutions which is as high as permitted by the weft thread moving at that moment through the weaving shed.

According to a second principle the transport velocity of each weft thread is measured, a signal which is representative for the measured transport velocity is supplied to a control system, in which this signal is converted into a control signal which influences the components of the weft transport system governing the velocity of the weft yarn. Therein a constant number of revolutions per minute of the machine is used and one aims at obtaining a constant weft time period by said control.

A particular control according to the second principle is characterized according to the invention in that one carries out continuous measuring of the time used for the weft transport, determines the average weft time period of a number of successive wefts and compares this time with the desired weft time period, in which a signal which is representative for the time difference to be measured, is supplied to a control system in which this signal is converted into a control signal which influences the components of the weft transport system determining the velocity of the weft yarn.

In this manner the conditions for the most efficient use of the weaving machine are established in that e.g. at each point of time the nozzles are fed with only so much flowing fluid of such a pressure that the desired weft velocity is accurately produced. As soon as the continuous measuring of the weft time observes a decreasing trend of the weft time, this means that apparently less energy for the weft transport is necessary, whereafter a corresponding signal is supplied to the transport system until thereafter an increasing trend of the weft time is observed.

It has been found that in such a weft transport system, which automatically has a narrow control according to this method, the number of weft errors is essentially less and thereby the cloth quality is essentially improved.

Further by this method the possibility exists to have the machine automatically adjust itself to the new weft yarn when a change to a different type of weft yarn takes place, by simply supplying a new operation signal which is representative for the weft time period desired with this type of weft yarn.

The invention is illustrated hereunder with reference to the drawing showing two embodiments as examples.

Figure 1:
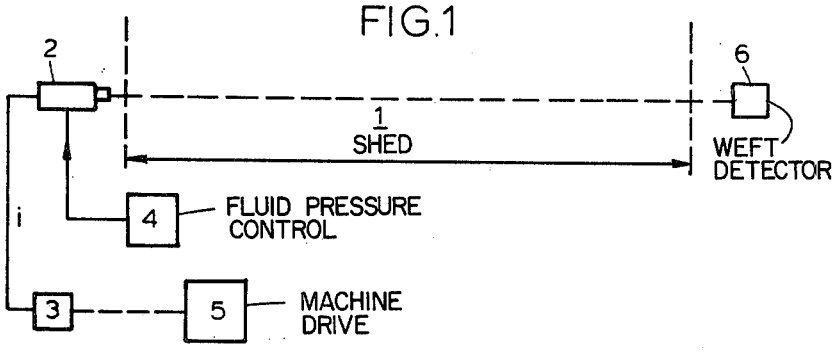
FIG. 1 shows a diagram of a weaving machine of the type in which the weft transport takes place through the intermediary of a jet of a flowing fluid, such as water or air.

In FIG. 1 the portion of the weaving machine containing the weaving shed is schematically shown and indicated by the reference number 1. Reference number 2 indicates the nozzle provided at one end of the weaving shed, to which on the one hand the weft yarn i is supplied by the weft yarn preparation device 3 and which on the other hand is fed with a flowing fluid, e.g. water or pressurized air, from a system 4 comprising a source for the relative fluid and the corresponding control means. Reference number 5 indicates the main driving mechanism of the machine, the drive of the weft yarn preparation device 3 being branched from said main drive mechanism. Reference number 6 indicates a weft detector provided at the end of the weft path of a weft thread through the weaving shed.

Figure 2:
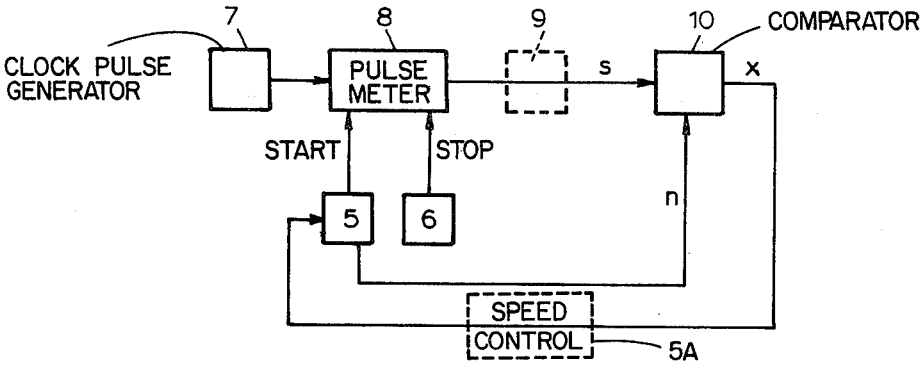
FIG. 2 shows a block diagram of a first embodiment of the control system according to the invention, to be applied to the machine according to FIG. 1.

In the control system according to FIG. 2 a clock pulse generator 7 feeds an impulse meter 8, which meter is coupled to the machine 5 such that the meter each time is reset to zero and started at the moment in which a weft thread is released for transport through the weaving shed, e.g. by opening a yarn clamp. The meter 8 further is connected to the detector 6 such that the meter is stopped as soon as a signal, supplied by the detector 6, indicates that the head of the relative weft thread has reached the end of its transport path through the weaving shed. The time impulses accumulated in this manner by the meter deliver an output signal s which is a measure for the average velocity at which the weft thread is moved through the weaving shed. The signal s is supplied, if necessary through a smoothing circuit 9, to a comparator 10, to which further a signal n is supplied which is proportionate with the number of revolutions per minute of the main drive mechanism 5. The comparator 10 is adjusted such that it supplies a positive or negative output signal x as soon as the ratio between the input signals s and n deviates upwardly or downwardly respectively with respect to a desired ratio value. If for example the comparator supplies a positive output signal x this means that the weft thread has traversed its path through the weaving shed amply within the time available therefor as determined by the number of revolutions of the machine. This means that the time available for the weft could have been shorter. Therefore the (positive) output signal x is used in that case by a speed control 5*a* to increase the number of revolutions per minute of the driving mechanism 5 such that the available weft time more closely approximates the really necessary weft time, so that the percentage of unused cycle time is kept as low as possible. Otherwise a negative output signal x will be used for slowing down the machine if it appears that the really necessary weft time is longer than the available weft time.

It is to be noted here that "available weft time" means the time in which already a predetermined idle time is included as a safety margin. It is further to be noted that the detector 6 need not necessarily be arranged at the end of the weft path through the weaving shed but in principle could be arranged at any arbitrary position along the weft path. So in principle it is possible to correct the number of revolutions per minute of the machine already during the transport of the relative weft thread.

Figure 3:
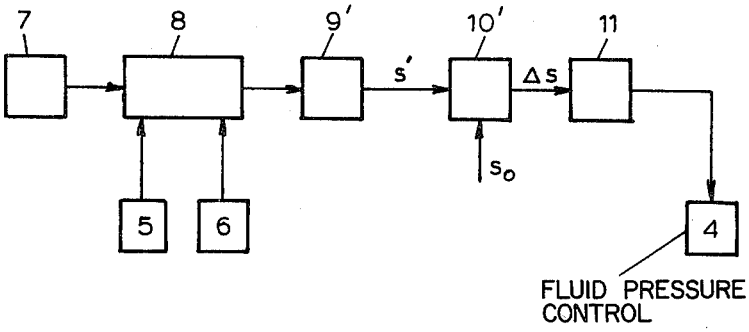
FIG. 3 shows a block diagram of the second embodiment of the control system according to the invention to be applied to the machine according to FIG. 1.

In the control system according to FIG. 3 those components which correspond to corresponding components in the control system according to FIG. 2 have been indicated by the same reference numbers.

Contrary to the control system according to FIG. 2, in the embodiment according to FIG. 3 reference number 9' indicates a circuit which has been arranged such that through a plurality of successive wefts, e.g. ten wefts, the average weft time is determined. The signal s' which is representative for this average weft time is supplied to a comparator 10', to which further a signal $s_0$ is supplied, which represents the desired average weft time. The signal difference $\Delta s$ as supplied by the comparator is supplied through a convertor 11 to the system 4 in order to increase or decrease the pressure or the quantity of the flowing fluid to be supplied to the nozzle 2, dependant on the sign of the correction signal.

We claim:

1. In a method of controlling the operation of a weaving machine in which each weft thread is moved through a shed by means of a flowing fluid, the step of correlating the speed of the movement of each weft thread through the shed with the speed of operation of the weaving machine by (a) measuring the time occupied by movement of a weft thread through the shed, (b) generating a first electrical signal which is a measure of such time, (c) generating a second electrical signal which is a measure of a predetermined fraction of the time occupied by a weaving cycle of the machine, (d) comparing said electrical signals and generating a third electrical signal which is a measure of the discrepancy between said first and second signals, and (e) using said third signal to control one of said speeds in order to eliminate the discrepancy between said first and second signals.

2. A method according to claim 1 wherein said third signal is used to control the speed of operation of the weaving machine.

3. A method according to claim 1 wherein said third signal is used to control the flow of said fluid and thus to control the speed of movement of each weft thread through the shed.

4. A method according to claim 3 wherein the first electrical signal is a measure of the average of the times occupied by movement of each of a plurality of successive weft threads through the shed, and the second electrical signal is a fixed target signal.

5. A weaving machine in which each weft thread is moved through a shed by means of a flowing fluid and in which the speed of the movement of each weft thread through the shed is correlated with the speed of operation of the weaving machine, comprising means for measuring the time occupied by movement of a weft thread through the shed, means for generating a first electrical signal which is a measure of such time, means for generating a second electrical signal which is a measure of a predetermined fraction of the time occupied by a weaving cycle of the machine, means for comparing said electrical signals and generating a third electrical signal which is a measure of the discrepancy between said first and second signals, and means responsive to said third signal for controlling one of said speeds to eliminate the discrepancy between said first and second signals.

6. In a weaving machine, the combination comprising a weft inserting means for moving weft thread through a shed at a given speed;

first means for generating a first signal in response to the measured time occupied during the movement of said weft thread through the shed;

second means for generating a second signal corresponding to the operating speed of the weaving machine;

a comparator connected to said first means and said second means to receive and compare said first signal and said second signal and to generate a third signal which is a measure of the discrepancy between said first and second signals; and means connected to said comparator to receive said third signal to adjust the speed of insertion of the weft thread relative to the speed of the weaving machine in response to said third signal.

* * * * *